US009840869B2

(12) United States Patent
Bogataj et al.

(10) Patent No.: US 9,840,869 B2
(45) Date of Patent: Dec. 12, 2017

(54) ROLLING GATE HAVING A DOOR LEAF IN THE FORM OF A FLEXIBLE CURTAIN

(71) Applicant: Efaflex Inženiring d.o.o. Ljubljana, Ljubljana (SI)

(72) Inventors: Marko Bogataj, Polhov Gradec (SI); Marko Dolinšek, Ljubljana (SI); Andrej Mazej, Vodice (SI)

(73) Assignee: Efaflex Inzeniring d.o.o. Ljubljana (SI)

( * ) Notice: Subject to any disclaimer, the term of this patent is extended or adjusted under 35 U.S.C. 154(b) by 0 days.

(21) Appl. No.: 14/646,156

(22) PCT Filed: Aug. 22, 2013

(86) PCT No.: PCT/EP2013/067473

§ 371 (c)(1),
(2) Date: May 20, 2015

(87) PCT Pub. No.: WO2014/082764

PCT Pub. Date: Jun. 5, 2014

(65) Prior Publication Data

US 2015/0337594 A1 Nov. 26, 2015

(30) Foreign Application Priority Data

Nov. 29, 2012 (DE) ..... 10 2012 111 611

(51) Int. Cl.
*A47G 5/02* (2006.01)
*E06B 9/70* (2006.01)
(Continued)

(52) U.S. Cl.
CPC ..... *E06B 9/70* (2013.01); *E05F 15/41* (2015.01); *E05F 15/686* (2015.01); *E05F 15/70* (2015.01);
(Continued)

(58) Field of Classification Search
CPC ..... E06B 9/70; E06B 9/58; E06B 2009/583; E06B 9/62; E06B 9/581; E06B 2009/585
(Continued)

(56) References Cited

U.S. PATENT DOCUMENTS 3,039,318 A * 6/1962 Clarke ..... E05D 13/14 16/198
3,180,401 A * 4/1965 Gambon ..... E06B 9/90 160/265
(Continued)

FOREIGN PATENT DOCUMENTS

DE 3411664 10/1985
DE 4324641 1/1994
(Continued)

OTHER PUBLICATIONS

Puncoh. English Translation of "DE 44 14 524". Accessed from https://worldwide.espacenet.com/.*
(Continued)

*Primary Examiner* — Katherine W Mitchell
*Assistant Examiner* — Johnnie A. Shablack
(74) *Attorney, Agent, or Firm* — Barnes & Thornburg LLP

(57) ABSTRACT

A high-speed rolling gate comprising a door leaf in the form of a flexible curtain, lateral guides in which lateral edges of the door leaf are received, and a drive which generates a driving force for driving the door leaf, wherein the door leaf has an elastically designed terminating element on a forward edge which is tensioned between the lateral guides by means of laterally applied transverse force components. The driving force of the drive engages on the terminating element of the door leaf and provides the laterally applied transverse force components for tensioning the terminating element of the door leaf and a tension force component substantially
(Continued)

Figure 1:
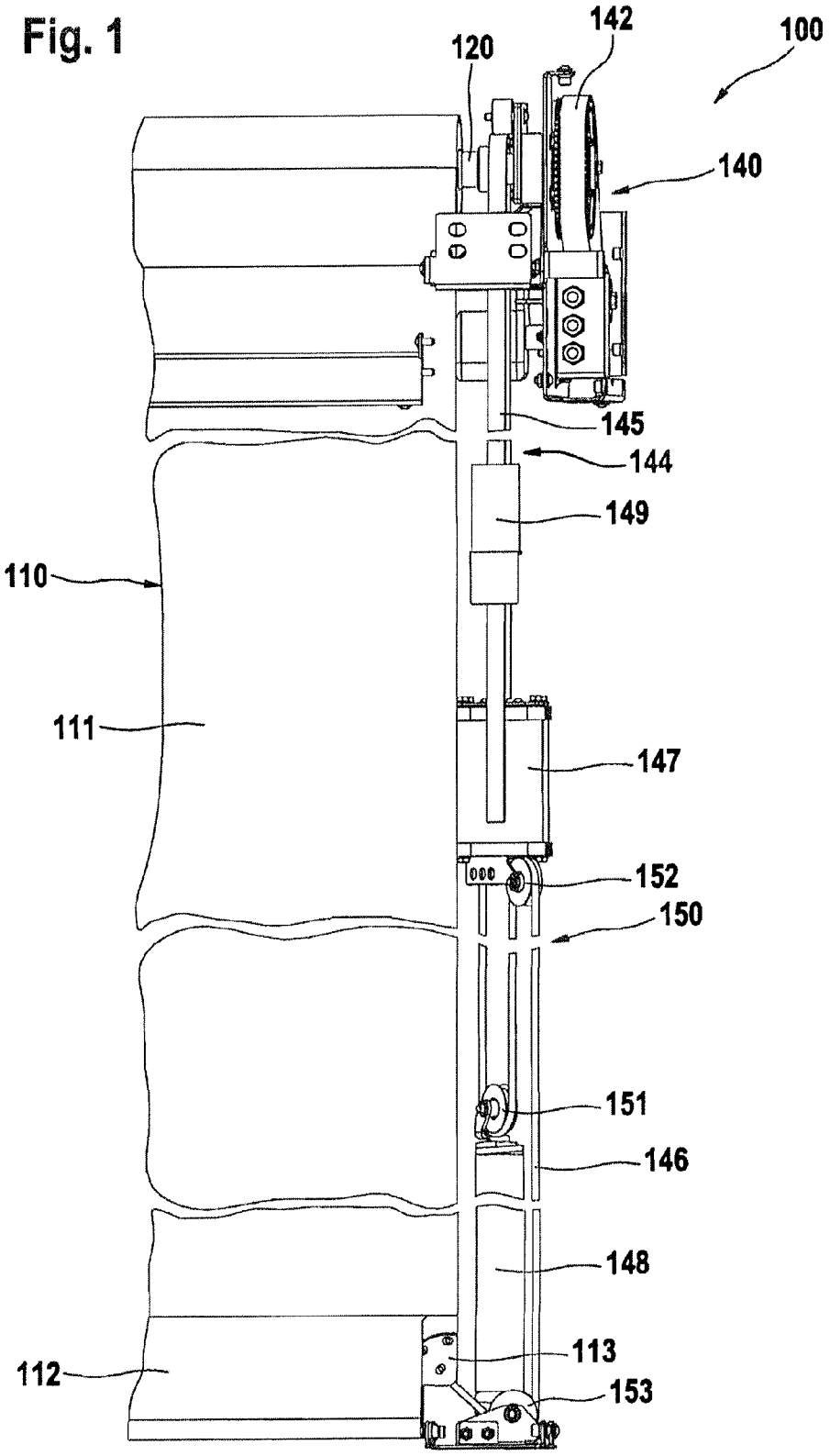

directed in the movement direction of the door leaf for closing the door leaf.

10 Claims, 12 Drawing Sheets

(51) Int. Cl.

| | |
|---|---|
| ***E06B 9/58*** | (2006.01) |
| ***E06B 9/80*** | (2006.01) |
| ***E05F 15/41*** | (2015.01) |
| ***E05F 15/686*** | (2015.01) |
| ***E05F 15/70*** | (2015.01) |
| ***E06B 9/13*** | (2006.01) |
| ***E06B 9/62*** | (2006.01) |
| *E06B 9/68* | (2006.01) |

(52) U.S. Cl.
CPC ..... *E06B 9/13* (2013.01); *E06B 9/58* (2013.01); *E06B 9/581* (2013.01); *E06B 9/62* (2013.01); *E06B 9/80* (2013.01); *E05Y 2900/11* (2013.01); *E06B 2009/6836* (2013.01); *E06B 2009/6845* (2013.01)

(58) Field of Classification Search
USPC ..... 160/265, 9, 189–192
See application file for complete search history.

(56) References Cited

U.S. PATENT DOCUMENTS 3,460,602 A * 8/1969 Hugus ..... E06B 9/13 160/265
3,878,879 A * 4/1975 Manns ..... E06B 9/62 160/133
4,252,172 A * 2/1981 Pommat ..... E06B 9/40 160/322
4,538,663 A * 9/1985 Looker ..... B65D 88/14 160/368.1
4,760,622 A * 8/1988 Rohrman ..... E05D 13/1207 16/196
4,800,946 A * 1/1989 Rosenoy ..... E06B 9/40 160/133
4,896,714 A * 1/1990 Ellis ..... E06B 9/08 160/264
4,997,022 A * 3/1991 Klein ..... E06B 9/68 160/265
5,025,847 A 6/1991 Mueller
5,048,588 A * 9/1991 Weishar ..... E06B 9/62 160/265
5,078,197 A * 1/1992 Weishar ..... E06B 9/17046 160/133
5,129,442 A * 7/1992 Warner ..... E05D 13/1215 160/265
5,139,074 A * 8/1992 Warner ..... E06B 9/581 160/265
5,159,967 A * 11/1992 Ashley ..... E06B 9/62 160/189
5,170,833 A * 12/1992 Taylor ..... E06B 9/68 160/265
5,222,541 A * 6/1993 Hornberger ..... E06B 9/13 160/190
5,271,448 A 12/1993 Delgado
5,353,859 A * 10/1994 Oltahfer ..... E05B 47/0002 160/291
5,368,084 A * 11/1994 Hying ..... E06B 9/40 160/265
5,620,039 A * 4/1997 Delgado ..... E06B 9/581 160/265
5,632,317 A * 5/1997 Krupke ..... E06B 9/13 160/264
5,655,591 A * 8/1997 Knutson ..... E06B 9/58 160/265
5,730,197 A * 3/1998 Schwingle ..... E06B 9/13 160/265
5,758,705 A 6/1998 Wagner et al.
5,915,448 A * 6/1999 Schulte ..... E06B 9/17046 160/265
5,957,187 A * 9/1999 Gruben ..... E06B 9/17046 160/267.1
6,019,156 A * 2/2000 Wagner ..... E06B 9/13 160/190
6,089,305 A * 7/2000 Gruben ..... E06B 9/13 160/264
6,119,758 A * 9/2000 Coenraets ..... E04H 4/101 160/273.1
6,439,292 B1 * 8/2002 Schutte ..... E06B 9/581 160/265
6,612,357 B1 * 9/2003 Beringer ..... E06B 9/88 160/10
7,252,133 B2 * 8/2007 Bengtsson ..... E06B 9/62 160/133
7,862,132 B2 * 1/2011 Tynes ..... A47L 15/4261 312/228
8,056,601 B2 * 11/2011 Kirby ..... E06B 9/42 160/265
8,113,264 B2 * 2/2012 Kirby ..... E04F 10/0607 160/265
8,162,028 B2 * 4/2012 Bengtsson ..... E06B 9/62 160/133
8,671,622 B2 * 3/2014 Thomas ..... E05D 13/14 49/141
8,899,297 B2 * 12/2014 Mazej ..... E06B 9/08 160/133
9,097,062 B2 * 8/2015 Letonje ..... E06B 9/15
9,309,717 B2 * 4/2016 Hardison, III ..... E06B 9/86
2003/0047291 A1 * 3/2003 Klein ..... E06B 9/15 160/133
2005/0247412 A1 * 11/2005 Bengtsson ..... E06B 9/62 160/265
2008/0041536 A1 * 2/2008 Bengtsson ..... E06B 9/62 160/265
2009/0229769 A1 * 9/2009 Kirby ..... E06B 9/42 160/239
2011/0146920 A1 * 6/2011 Mazej ..... E06B 9/08 160/311
2014/0246157 A1 * 9/2014 Letonje ..... E06B 9/0646 160/188
2015/0337594 A1 * 11/2015 Bogataj ..... E06B 9/13 160/9

FOREIGN PATENT DOCUMENTS

| | | | |
|---|---|---|---|
| DE | 29501048.7 | 4/1995 | |
| DE | 4414524 | 10/1995 | |
| DE | 4414524 A1 * | 10/1995 | ..... E06B 9/581 |
| DE | 69831080 | 6/2006 | |
| DE | 202010007949 | 10/2010 | |
| EP | 0675261 | 10/1995 | |
| EP | 2402543 | 1/2012 | |
| JP | 6-158962 | 6/1994 | |
| WO | 0053880 | 9/2000 | |

OTHER PUBLICATIONS

Kolan, "DE4414524," Mar. 28, 1994. English translation obtained from <https://worldwide.espacenet.com/>.*
English translation of the International Preliminary Report on Patentability in PCT/EP2013/067473, dated Jun. 2, 2015.
English Abstract of Japanese Publication 06-158962, published Jun. 7, 1994.

* cited by examiner

ROLLING GATE HAVING A DOOR LEAF IN THE FORM OF A FLEXIBLE CURTAIN

CROSS REFERENCE TO RELATED APPLICATIONS

This application is a U.S. nationalization under 35 U.S.C. §371 of International Application No. PCT/EP2013/067473, filed Aug. 22, 2013, which claims priority to German Patent Application No. 10 2012 111 611.3, filed Nov. 29, 2012. The disclosures set forth in the referenced applications are incorporated herein by reference in their entireties.

The invention relates to a rolling gate, in particular a high-speed rolling gate, comprising a door leaf in the form of a flexible curtain, lateral guides in which lateral edges of the door leaf are received, and a drive which generates a driving force for driving the door leaf, wherein the door leaf comprises an elastically designed terminating element on a forward edge which is tensioned between the lateral guides by means of laterally applied transverse force components.

Rolling gates with a flexible curtain of PVC or the like have been used in practice for a long time. They have proved of excellent value for producing a wind-tight closure, for instance, between individual rooms in larger halls or the like. As compared to gate arrangements with door leaves formed of slats or sections such rolling gates have the advantage of having lower weight. It is therefore possible to operate them at very high speeds.

Such rolling gates as a rule have a winding shaft on which the curtain is wound during opening. In this process, lateral edges of the curtain are guided in associated lateral guides to also produce a substantially wind-tight closure here. Since a curtain does not have inherent stiffness, conventional rolling gates are as a rule provided with a rigid end plate on the forward edge of the door leaf. It is usually designed as a metal profile and stiffens the curtain transversely to the direction of movement of the door leaf. Typically, this end plate reaches up to the region of the lateral guides and has a predetermined weight, so that the curtain is tensioned also in the direction of movement across its entire breadth between the terminating element, on the one hand, and the winding shaft, on the other hand.

Since such curtain is normally fastened directly to the winding shaft, the driving force for opening the rolling gate is applied directly from the winding shaft to the curtain. For the closing of such rolling gates the winding shaft is operated in the opposite direction such that it releases the curtain. Due to the inherent weight of the end plate the curtain winds off the winding shaft automatically and closes the door opening.

In order to enable reliable and quick closing of such rolling gates it is additionally known to promote the process by means of tension forces on the end plate. Examples of such rolling gates can be found in DE 34 11 664 A1 and in DE 43 24 641 A1. Here, traction ropes are provided which are pretensioned by means of spring force or weights and which act on both sides of the end plate and pretension it in the direction of the closing of the door. Apart from promoting closing process it is further achieved that the curtain is tensioned even better in the direction of movement of the rolling gate. It is then less susceptible to bulging under wind load or the like. Thus, a reliable closing of the door opening is achieved. With such systems it is moreover possible to better prevent disturbances such as, for instance, canting of the door leaf in the course of the closing process.

Since door openings provided with such rolling gates are as a rule frequented many times, and in the light of the definitely substantial speeds of movement of such door leaves, there is, however, considerable risk of collisions, e.g. with persons or fork lifts passing the door opening, etc. In order to counteract this it is, for instance, known to install optical signaling systems on such rolling gates. Door light grid systems have proved to be of particular value for this purpose. The installing of such systems is, however, associated with effort. Moreover, these systems are as a rule only suited to detect obstacles which are already present in the plane of movement of the door leaf. Fork lifts approaching from the side or the like which are on a collision course are, however, not detected or only detected by means of additional signaling systems in adjacent regions of the door opening. Such collisions in practice often result in substantial damage both to the door leaf, i.e. the curtain and the end plate, and to the object hit. Therefore, systems have been developed which enable a deflecting of the end plate from the plane of the door leaf in cases of collision.

An example of this can be found in EP 0 675 261 A1 and/or in DE 44 14 524 A1. Here, the end plate is guided at both sides by means of carriages in the lateral guides such that it is trapped in the direction of movement of the door leaf, but is capable of swiveling transversely thereto. Moreover, the end plate is connected on both sides with tensioning ropes such that a tensile connection between the gate drive and the end shield is maintained even if the end shield deflects. The tensioning ropes are elastically pretensioned, so that a corresponding movement path is enabled. They support a resetting of the end plate to its normal position. To the extent that no case of collision exists, these tensioning ropes serve, like in the constructions already explained, the tensioning of the curtain in the direction of movement of the door leaf. In cases of collision it is, in view of the mass of the rigid end plate, however still possible with the rolling gate according to EP 0 675 261 A1 that a substantial damage of the end plate and/or of the person involved or the object hit takes place.

An alternative design of a deflectable end plate is known from DE 295 01048 U1. This document discloses a rolling gate with a flexible curtain and a rigid end plate in the form of a lower beam. A respective guide element which is adapted to be folded away laterally is coupled to the lateral ends of the end plate. This enables the exiting of the guide element from the lateral guides and accordingly the swiveling out of the end plate from the plane of the door leaf.

Another example of a deflectable end plate is given in DE 43 24 641 A1 which has already been mentioned above. The rigid end plate which exists here and which is nevertheless elastically deformable to a certain extent is connected with a respective guide arm in the region of the lateral guides. For this purpose an attachment at the respective guide arm is inserted loosely into a recess on the associated lateral end of the end plate. The guide arm is engaged by the traction rope for tensioning the curtain in the closing direction, on the one hand, and by a band which is available to be flush in the same operational axis as the traction rope, but is of opposite orientation and is pretensioned, on the other hand. By means of this the guide arm is moved similar to the curtain. For this purpose the band is also wound on the winding shaft. In the case of collision the restrictedly possible elastic deformation of the otherwise rigid end plate is sufficient for the attachments to be able to exit from the recesses on the end plate. The curtain can then swivel out from the plane of the door leaf together with the end plate. However, due to the intrinsically rigid design of the end plate there is still substantial risk of damage for the end plate and for people concerned, etc. Moreover, the loose plug connection of this known door arrangement is an uncertain system, which is a problem in particular in the case of a high-speed operation. It cannot be excluded here that the connection is released due to wobble movements, etc.

Another systematic approach for a collision protection device on a rolling gate has become known from EP 2 402 543 A2. This rolling gate whose curtain is conventionally wound on and/or wound off in a motor-driven manner on a winding shaft does not comprise any end plate of a rigid metal profile or the like, but a terminating element which is intrinsically elastic and thus designed to be deformable in the plane of the curtain and transversely thereto. It is thus capable of evading obstacles and thus avoiding damage. For this purpose, the terminating element comprises a hinge body and/or a chain which may additionally be pretensioned by an elastic traction means. The hinge body and/or the chain comprise a certain inherent weight, so that the terminating element automatically assumes a stretched position under the influence of gravity. A traction means such as a rubber cord or a rubber band is used here as an additional element for the tensioning of the terminating element, so that the gate curtain is simultaneously also tensioned in the direction of movement of the door leaf. When the rolling gate is closed, the inherent weight of the hinge body and/or of the chain on the terminating element has a supporting effect caused by gravity. The two elastic traction means arranged on both sides also promote the closing process.

One of the traction means serves simultaneously also as an indicator of the existence of a collision case in that it cooperates with a sensor detecting the position of the traction means in the region of the terminating element. If a collision case exists, the orientation of the traction means changes, so that the sensor may output an appropriate signal.

A disadvantage of the rolling gate pursuant to EP 2 402 543 A2 is, however, that the hinge body and/or the chain must have a definitely substantial weight to be able to fulfil the desired function of tensioning the curtain and/or of promoting the closing movement of the same. Due to the mass thus existing, these elements continue to represent a danger for persons or objects hit by the forward edge of the rolling gate, so that injuries or damages may still occur here. Since the terminating element is not of rigid design there is additionally increased danger that canting occurs in the course of the closing process of the door leaf.

DE 698 31 080 T2 finally discloses a further design of a rolling gate with an elastically designed terminating element. In order to provide a reliable closure of the door opening when the rolling gate is closed, this terminating element is coupled with carriages on the sides which are guided in lateral guides. Moreover, a tensioning strap is provided within the terminating element. In this manner, the terminating element is tensioned in transverse direction by appropriate transverse force components.

In the case of collision a detachment of the terminating element from the lateral carriage arrangements is possible since these elements are kept to each other by magnetic force only. The terminating element and partial areas of the curtain may then deflect from the plane of the door leaf, adapt themselves to obstacles they hit and/or deform around them elastically. In this manner damage of the terminating element and of the object concerned, etc. is avoided to a certain scope.

However, a high degree of precision is required for adjusting the intensity of the magnetic force such that a sufficiently stable connection exists, on the one hand, so that the coherence of the components required for the opening and the closing is ensured and such that, on the other hand, the terminating element detaches in time from the lateral carriage arrangements before damage occurs.

This known rolling gate is driven in a per se conventional manner by the actuation of the winding shaft on which the curtain is wound during the opening of the rolling gate. In order to promote the closing process of the curtain, a ballast tube is moreover arranged at the foremost end of the forward edge, said ballast tube being filled with a deformable material such as sand. This ballast tube provides a weight at the underside of the lifting gate illustrated, which does not just support the closing process as such, but also tensions the curtain in the vertical direction. This additional weight, however, restricts the opening speed.

Since the ballast tube pursuant to DE 698 31 080 T2 thus must have considerable weight, the mass associated therewith represents, similar to a conventional end profile, a risk for the object hit, etc. Here, too injuries of persons or damage to fork lifts, products, etc. are still possible.

It is therefore an object of the invention to improve a generic rolling gate such that it has high operational reliability and represents less danger to people or objects in cases of collision.

This object is solved by a rolling gate with the features of claim 1. It is characterized in particular in that the driving force of the drive engages on the terminating element of the door leaf and thus provides the laterally applied transverse force components for the tensioning of the terminating element of the door leaf and a tension force component directed substantially in the direction of movement of the door leaf for closing the door leaf.

In accordance with the invention it was thus recognized for the first time that it is possible to let the driving force for the closing of the door opening of such a rolling gate, although it is designed with a flexible curtain with a curtain section and an elastic, i.e. intrinsically freely elastically deformable terminating element, also have an effect on the terminating element. It is thus advantageously possible now to do without components with a large mass in the terminating element. This reduces the danger of injury for persons possibly hit by the terminating element quite substantially. Likewise, the danger of damage to goods and/or work tools in the case of collision is reduced. Moreover, the terminating element itself is then also less susceptible to damage.

This is also supported by the fact that the terminating element, due to its elastic design, is designed to be deformable without damage in the plane of the curtain and also transversely thereto and can therefore adapt itself flexibly to obstacles and/or deform around same. This is not achieved with a conventional end plate even if it should be deflectable to a certain degree. Moreover, by means of the transverse force components applied, the terminating element of the rolling gate according to the invention is capable of returning to its stretched normal position without damage after the obstacle has been removed, etc., i.e. there are no permanent changes in shape.

At the same time, however, it is also achieved that the closing process of the rolling gate can take place in a particularly reliable manner. The tension force component for the closing of the door leaf provided at the rolling gate in accordance with the invention thus constitutes an active drive by means of which this movement can be controlled more exactly than by means of the passively acting systems with the weight in prior art.

Moreover, the rolling gate according to the invention is independent of a concrete orientation, so that it need not necessarily be arranged as a lifting gate with upright orientation as in prior art, but enables, for instance, also an oblique or horizontal closure between rooms or different areas.

Furthermore, a reliable tensioning of the elastically designed terminating element is, however, also achieved. In the normal case it is thus, with respect to the stabilization of the forward edge of the curtain, functionally quasi equivalent to a rigid end plate of a metal profile without, however, comprising its disadvantages with respect to the weight and with respect to the danger of injury or damage.

Another advantage of the rolling gate in accordance with the invention is that it can be used with high functional reliability and is characterized by a long life.

The rolling gate according to the invention thus provides for the first time that the driving force of the drive is used simultaneously for the driving and tensioning of the curtain in the direction of movement and for the tensioning transversely thereto in the region of the forward edge. The rolling gate according to the invention may have a surprisingly simple construction. It is thus hardly failure-prone and can additionally be provided in a cost-efficient manner. In many applications it is moreover possible to do without additional signaling systems such as door light grid systems or the like.

Advantageous further developments of the rolling gate according to the invention are the subject matters of the dependent claims.

Thus, the drive of the rolling gate may comprise a respective traction element in the region of the lateral guides which transfers the driving force to the terminating element of the door leaf. This enables a particularly simple constructional design of the drive system and is characterized by high reliability. Such traction elements have been used with rolling gates for a long time and have proved to be of great value.

It is further of advantage if the traction element is designed in two-part form with a driving part and a tension force transferring part, wherein the driving part is designed as an endless element for transferring the driving force, and wherein the tension force transferring part transfers the driving force transferred with the driving part to the terminating element of the door leaf. The course of movement of the rolling gate according to the invention can thus be controlled even more exactly. Moreover, an even more precise adjustment of the transverse force component and/or of the tension force component is possible. Furthermore, it is possible to use identical components for rolling gates with different dimensions to a high degree in this manner.

The driving part of the traction element may be formed as a toothed belt, a chain or the like at least in a partial section. With such elements it is possible to provide a positive locking for the traction element, so that a particularly reliable operation of the rolling gate is enabled.

Moreover it is possible that the tension force transferring part of the traction element is designed as a traction rope. Thus, a permanent transfer of the tension forces can be achieved in an approved manner.

If the drive comprises a weight balancing means with a tension spring and/or a weight, the construction of the rolling gate according to the invention is further simplified. It is then possible to do without a separately designed weight counterbalance independently of the drive. Moreover, the rolling gate according to the invention is then given a particularly compact and simple construction.

In this respect it is a further advantage if the drive comprises a pulley arrangement over which the traction element is guided. It is thus possible to advantageously control the drive arrangement such that a particular door leaf movement can be achieved with a short movement path at the drive element, for instance, a pinion at the motor. Moreover, it is also possible to adjust the acting forces in an advantageous manner.

According to a further advantageous design it is possible that the terminating element of the door leaf is coupled on both sides with a carriage moving in a guided manner along with the terminating element in the lateral guides and carrying a deflecting means by which the traction element is deflectable from the region of the lateral guides to the terminating element. Thus, the traction element is oriented with respect to the terminating element such that it provides a particularly suitable division of the driving force into the transverse force component and/or the tension force component. It is of particular advantage that, due to the carriage moved along with the terminating element, the angle at which the traction element engages on the terminating element is always the same, irrespective of the closure state of the door leaf. Thus, the same tension force component is accordingly applied on the terminating element of the door leaf during the entire closure process. Likewise, the same transverse force component for tensioning the terminating element is provided in each intermediate level in the course of the closure process. This enables an even more reliable operation of the rolling gate according to the invention.

If the carriages are guided in the lateral guides by means of rolls it is possible to guide them almost frictionless, and therefore they have a long lifespan. Moreover, the reliability of the rolling gate according to the invention is further increased.

It is of further advantage if the terminating element of the door leaf is detachably coupled on both sides with the respective carriage such that it is deflectable from the plane of the door leaf in the case of collision. Then, the rolling gate according to the invention also provides a kind of active collision protection device and does not only provide a passive protection device by the elastically designed terminating element. The danger of damage to the rolling gate according to the invention or to objects concerned, etc. in the course of a collision can be reduced distinctly by that. Since the traction elements on both sides are, however, still connected with the terminating element of the door leaf, it is not released completely and is moreover resettable to its normal position by means of the traction elements.

In this respect it is of advantage if the carriages are each connected with lateral edge elements of the terminating element by means of a snapping connection. Such snapping connection can be released non-destructively in the case of collision and subsequently be established anew. The danger of damage to the terminating element in the case of collision is thus further reduced. Moreover, it is possible with simple means to reset the rolling gate into its operating state. Furthermore, such snapping connection constitutes a reliable coupling manner which permanently enables a trouble-free normal operation of the rolling gate according to the invention.

In this respect it has further turned out to be advantageous if the snapping connection is designed such that the lateral edge elements of the terminating element, if the terminating element is deflected, automatically snap into the carriages in the course of a closing movement of the door leaf. Thus, a resetting to the normal state of the rolling gate according to the invention is possible after a case of collision in very short time and with little effort. In the scope of the invention it is in particular provided for the first time that this resetting to the normal position is not performed in the course of an opening movement of the door leaf, but of a closing movement. This leads to the further advantage that, in unfavorable cases, a manual interference is possible without problems if required so as to reestablish the snapping connection between the terminating element and the lateral carriages since the resetting process takes place in an area good to access, as a rule on the bottom side.

It is of further advantage if a sensor device is arranged on at least one carriage, said sensor device detecting the coupling state between the carriage and the terminating element. In this manner it is possible to detect a case of collision in a particularly reliable way. It is irrelevant whether the coupling state was released by the lateral exiting of the terminating element from the plane of the door leaf or by an elastic deformation of the terminating element in the plane of the door leaf. By means of the sensor device an appropriate failure routine can be initiated immediately and reliably. It consists as a rule at least in that the rolling gate opens and thus provides a larger clearance height in the door opening.

Figure 2:
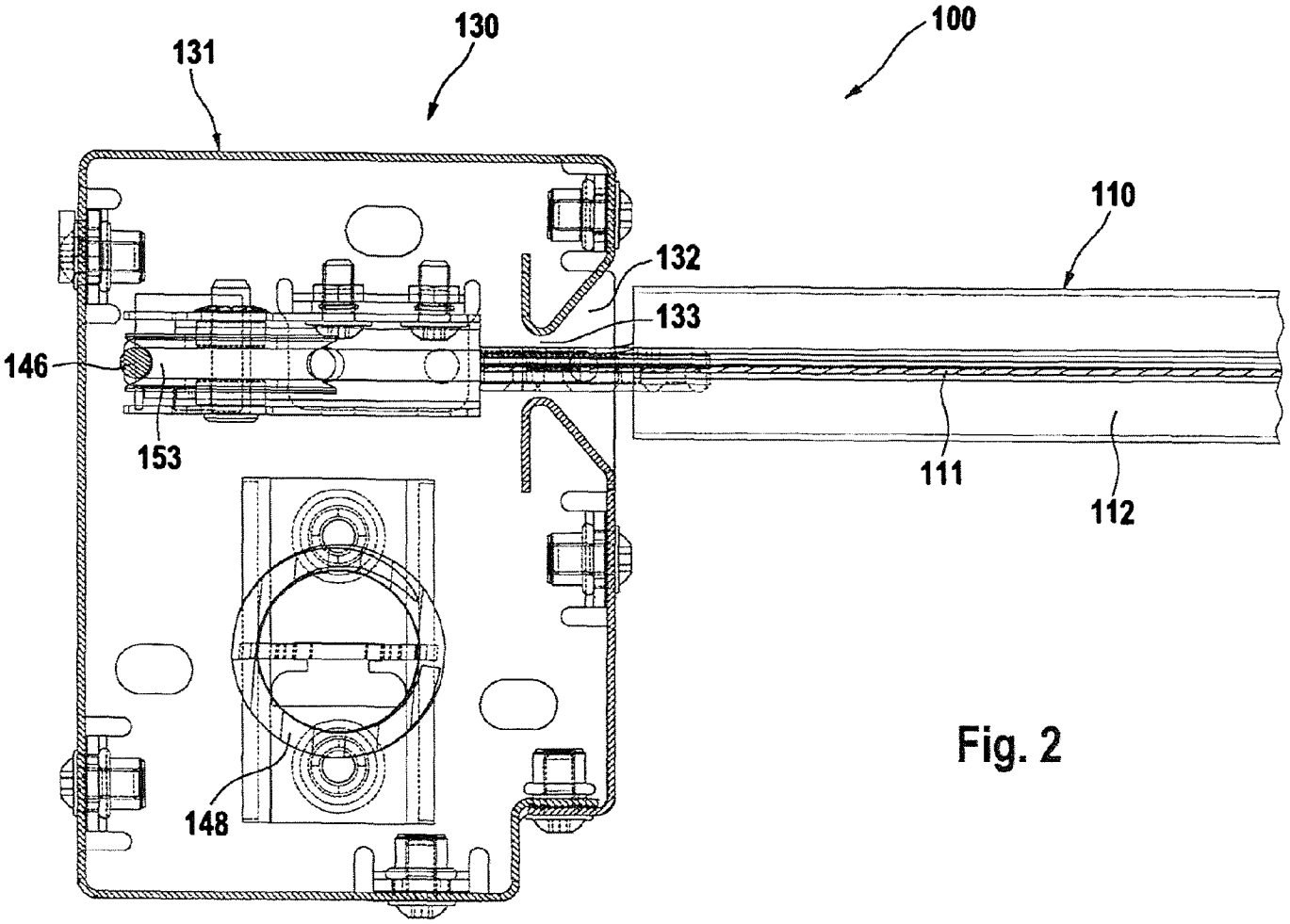
Figure 3:
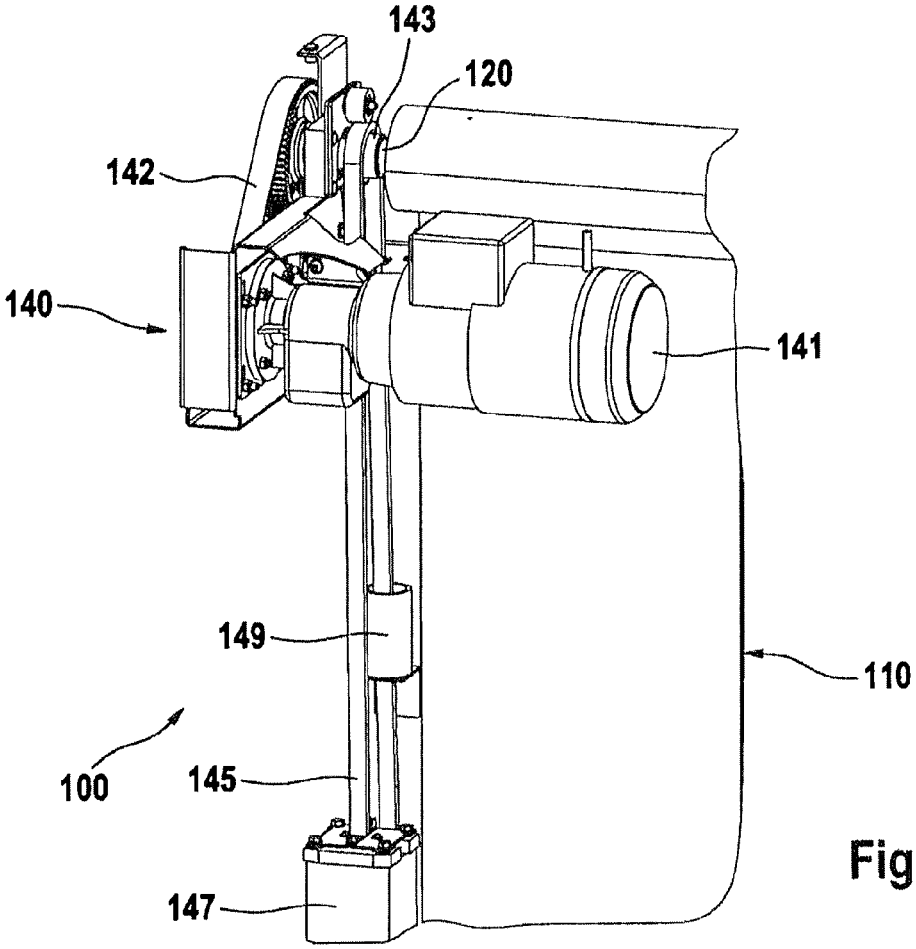
Figure 4:
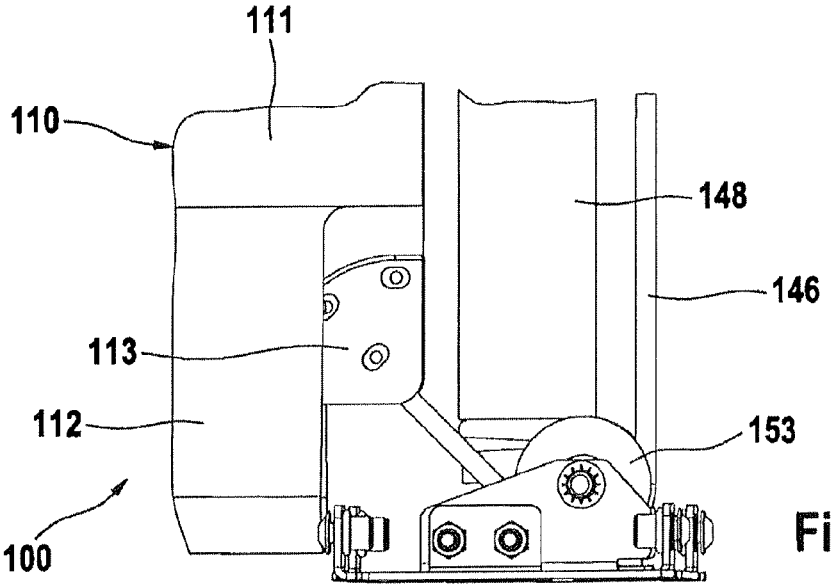
Figure 5A:
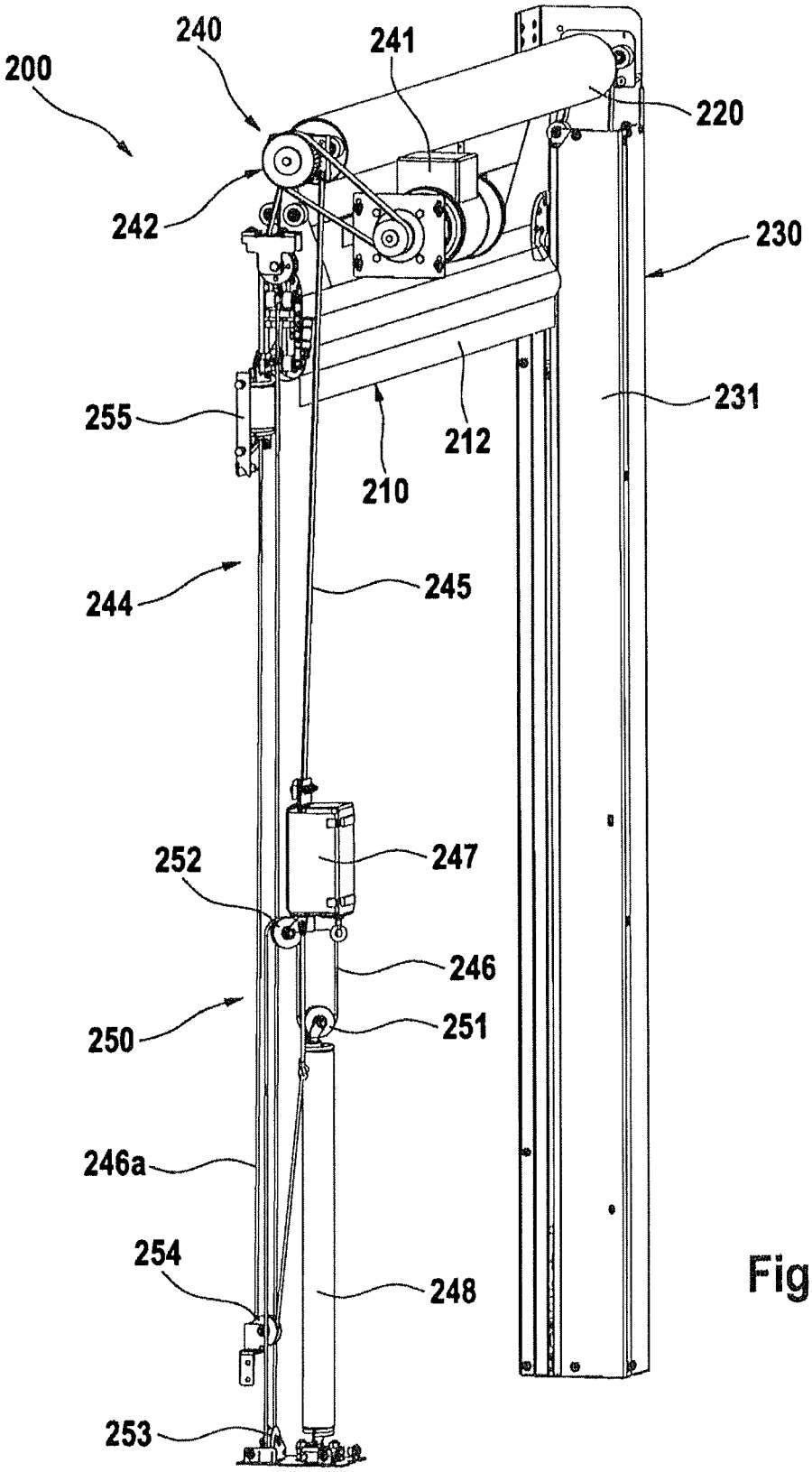
Figure 5B:
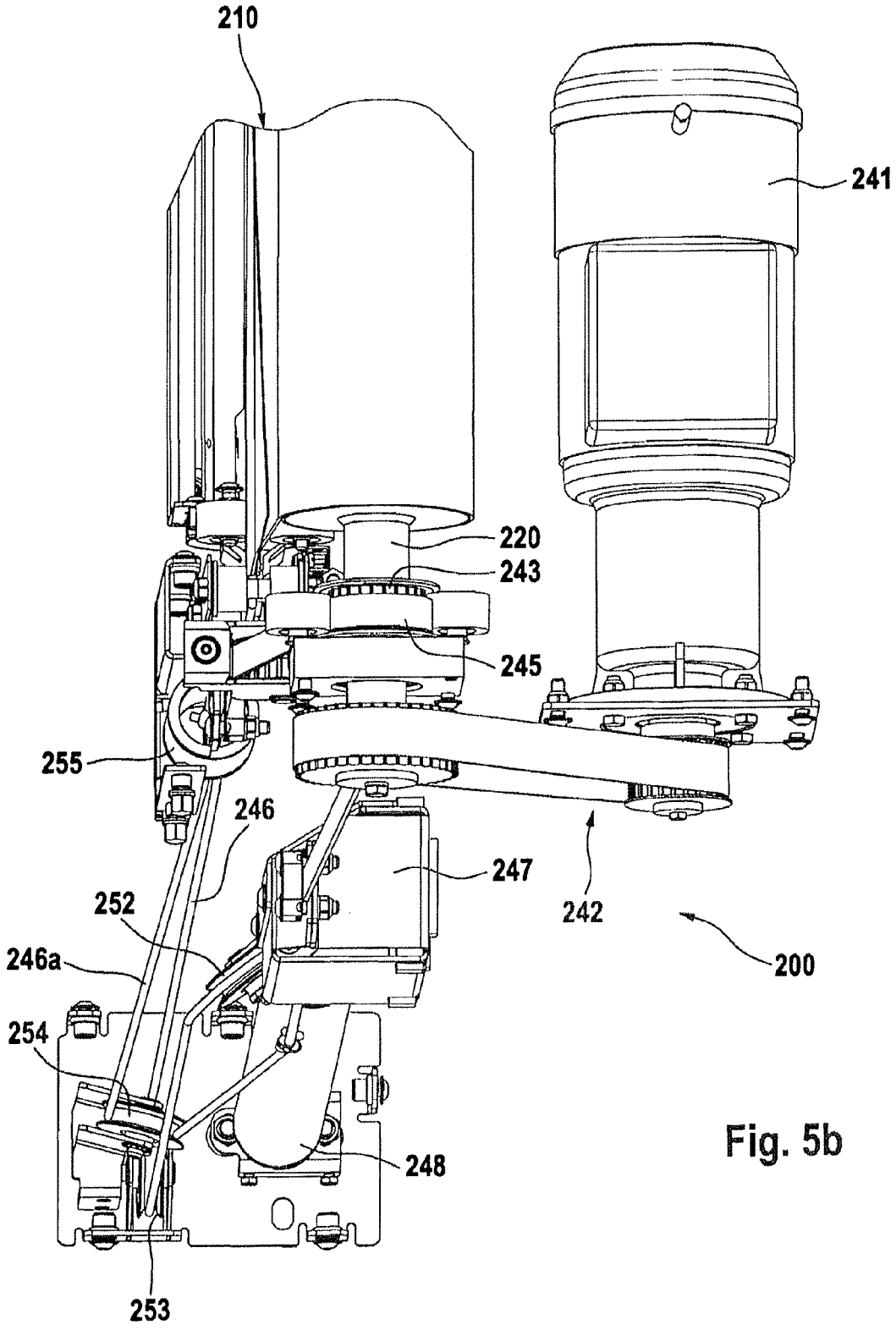
Figure 6A:
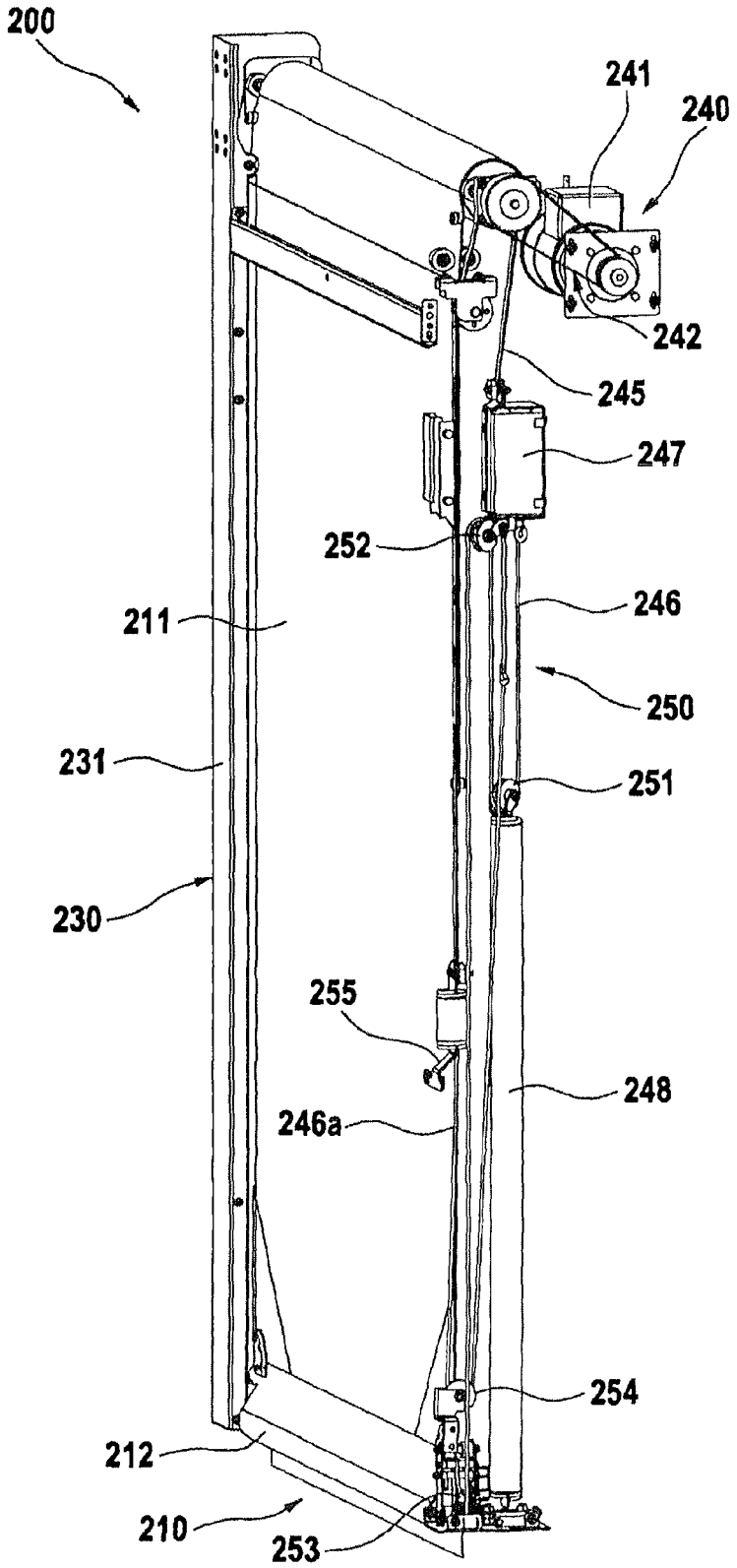
Figure 6B:
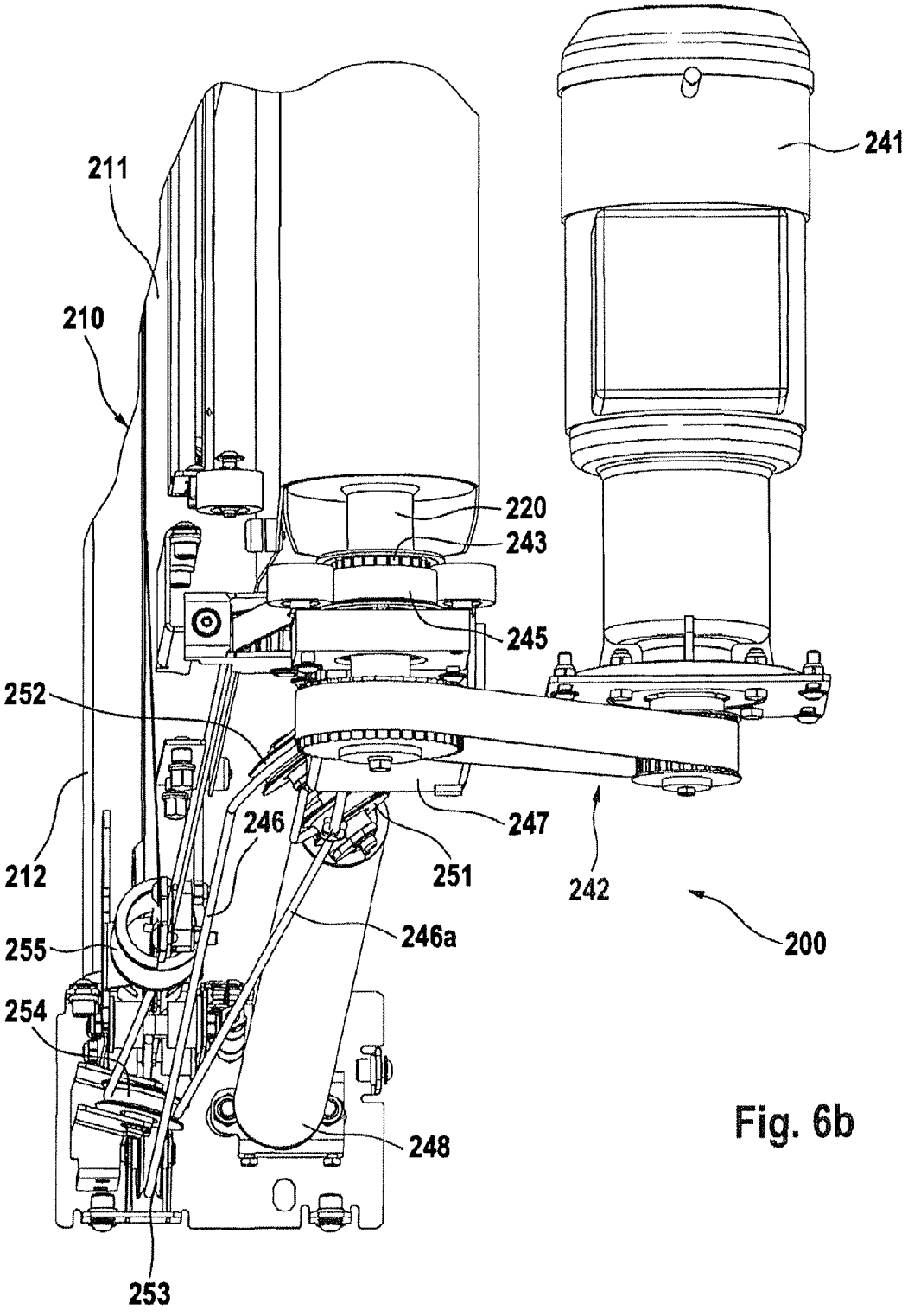
Figure 7:
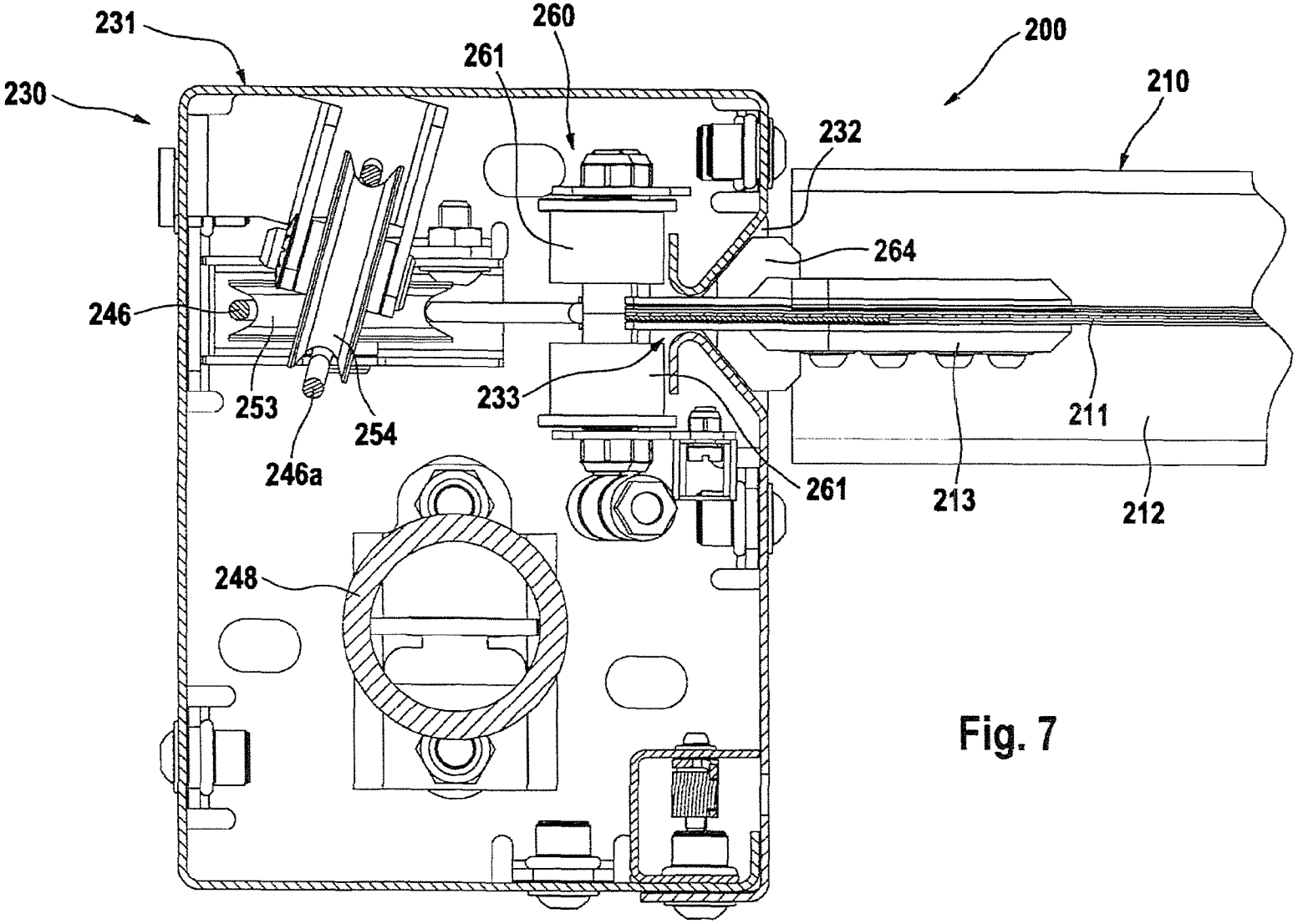
Figure 8:
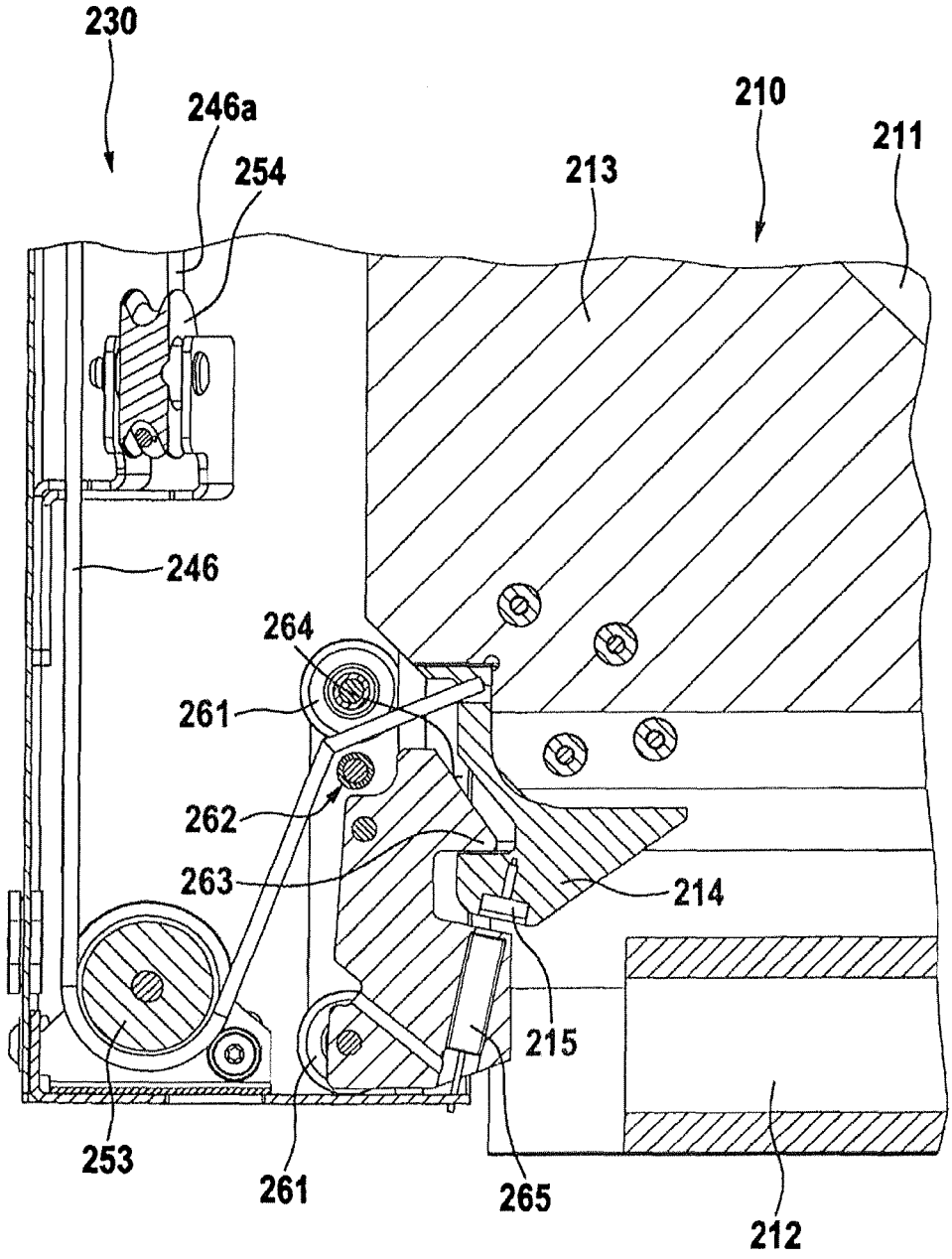
Figure 9:
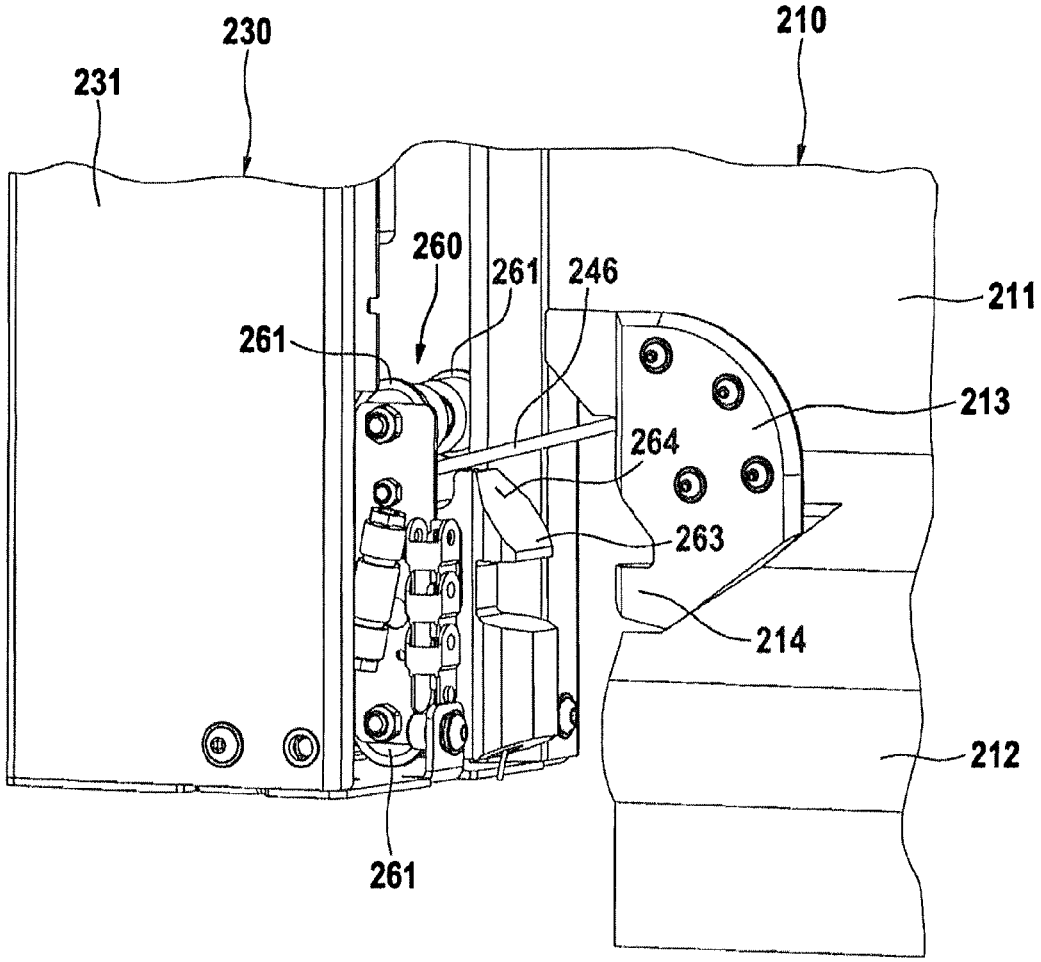
Figure 10:
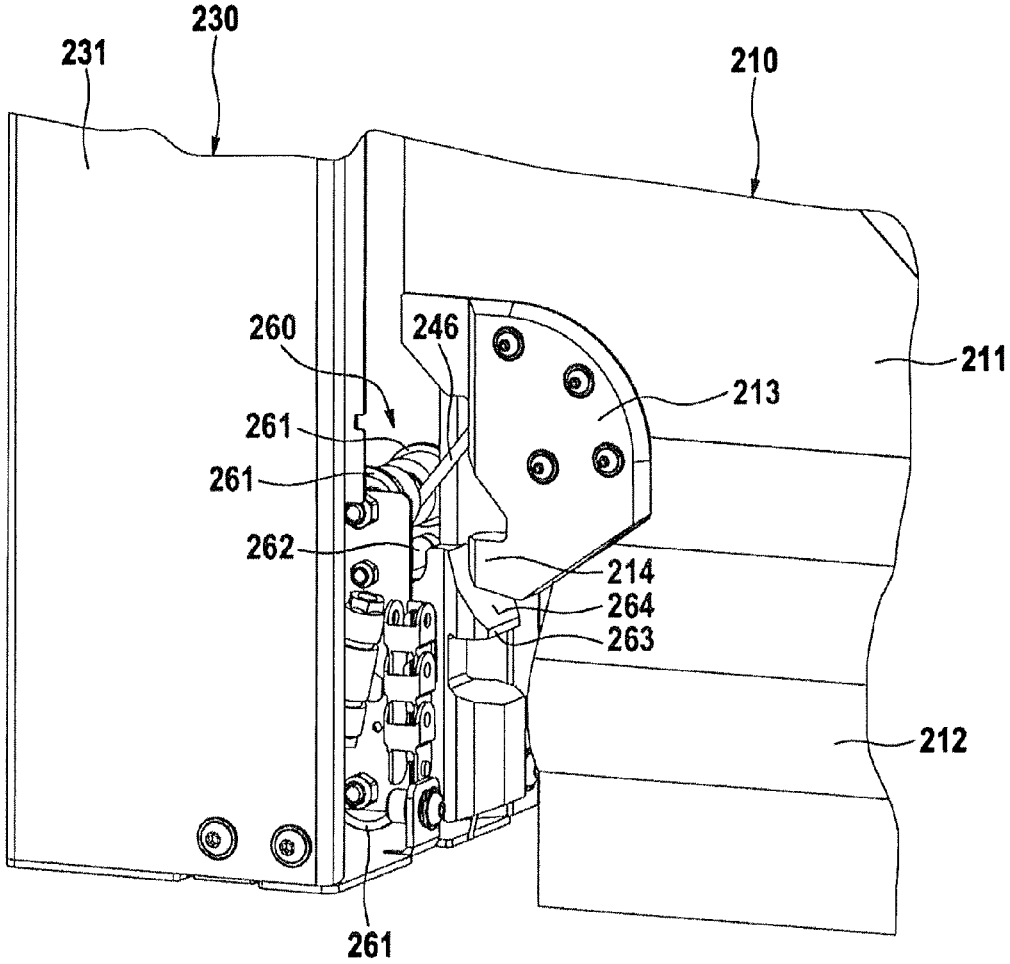
Figure 11:
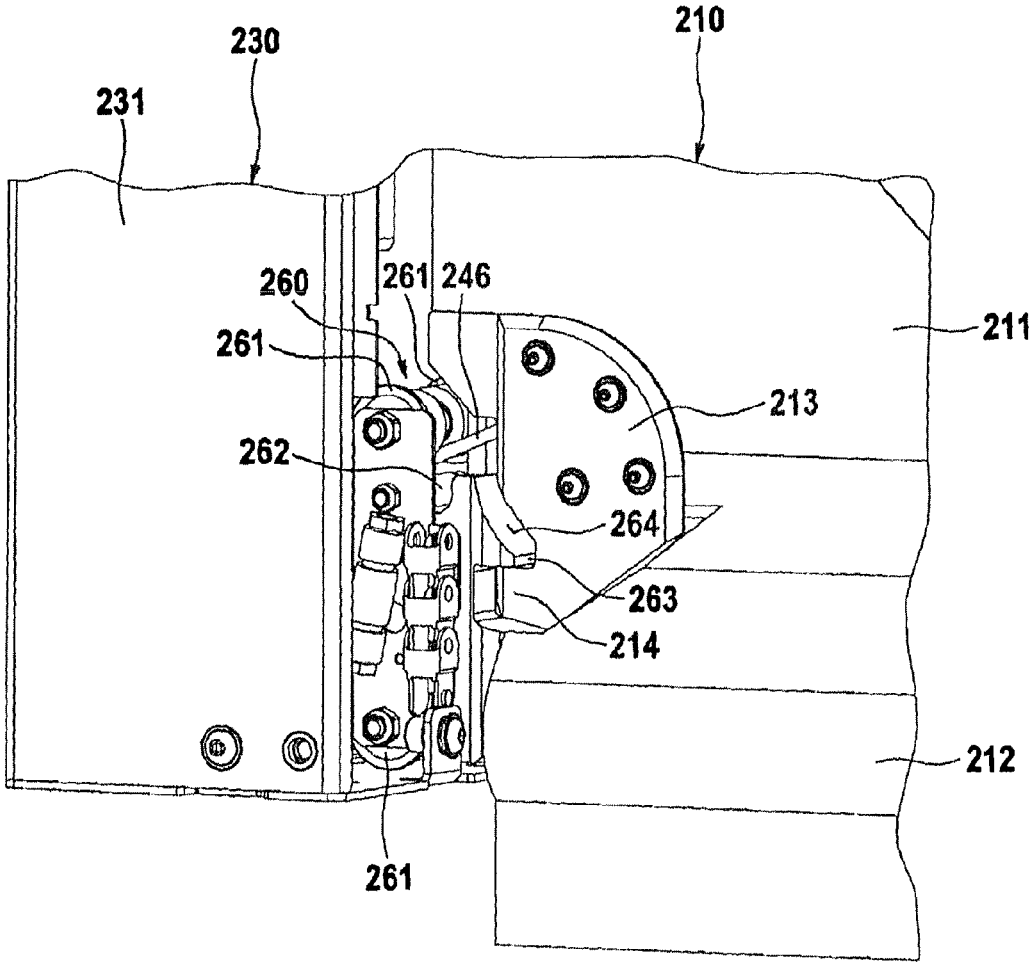

The invention will be explained in more detail in the following in embodiments by means of the Figures of the drawing. There show:

FIG. 1 a section from a schematic front view of a rolling gate according to the invention in accordance with a first embodiment, wherein the frame housing of the lateral guide has been omitted for illustration purposes;

FIG. 2 a sectional plan view of a lateral edge region of the rolling gate pursuant to FIG. 1;

FIG. 3 a perspective detailed view of a drive system of the rolling gate according to the first embodiment;

FIG. 4 a detailed view in the bottom-side end region on the rolling gate according to the first embodiment;

FIG. 5*a* a perspective view of a rolling gate according to a second embodiment in an open state, wherein frame parts have been omitted for illustration purposes;

FIG. 5*b* a perspective slanted view from above of the rolling gate according to the second embodiment in the open state;

FIG. 6*a* a perspective view of the rolling gate according to the second embodiment in the closed state;

FIG. 6*b* a perspective slanted view from above of the rolling gate according to the second embodiment in the closed state;

FIG. 7 a sectional plan view of a lateral edge region of the rolling gate according to the second embodiment;

FIG. 8 a section through the lateral edge region of the rolling gate according to the second embodiment with a closed rolling gate at the lower end of the lateral frame;

FIG. 9 a perspective view of the rolling gate according to the second embodiment with a deflected terminating element;

FIG. 10 a perspective view similar to FIG. 9 in the course of a resetting of the deflected terminating element to the normal operating state; and FIG. 11 a perspective view similar to FIGS. 9 and 10, wherein the terminating element has been reset to its normal position.

FIGS. 1 to 4 illustrate a first embodiment of a rolling gate 100.

It comprises a door leaf 110 consisting substantially of a flexible curtain with a curtain section 111 and a terminating element 112 arranged at the forward edge thereof. The forward edge is the edge region and/or the edge at the curtain section 111 which is positioned in front in the direction of movement during the closing of the door leaf 110.

The rolling gate 100 which is designed as a lifting gate in the instant case further comprises a winding shaft 120 on which the door leaf 110 is wound during the opening of the rolling gate 100. Moreover, the rolling gate 100 comprises lateral guides 130 one of which is shown in FIG. 2 and which receive lateral edges of the door leaf 110. Finally, the rolling gate 100 comprises a drive 140 which generates a driving force for driving the door leaf 110.

FIG. 2 is a sectional plan view of one of the lateral guides 130. As may be gathered therefrom, it comprises a frame box 131 forming a feed hopper 132 in the region of the associated lateral edge of the door leaf 110, said feed hopper 132 opening into a guide slot 133. In the illustrated embodiment the feed hopper 132 has an opening angle of approximately 100°. The guide slot 133 has been chosen such that the door leaf 110 can be guided therein with clearance.

In accordance with the illustration in FIG. 3 the drive 140 comprises a motor 141 which is coupled with the winding shaft 120 via a transmission gearing 142. The winding shaft 120 is rotated by the motor 141. Depending on the direction of rotation the door leaf 110 is wound on the winding shaft 120 or wound off the winding shaft 120.

A drive pinion 143 driving a traction element 144 is further arranged on the winding shaft 120 laterally outside of the winding area for the curtain section 111. This traction element 144 serves to apply a driving force for the closing of the door leaf 110 on the terminating element 112. Simultaneously, a transverse force component is applied on the terminating element 112 by means of which it is tensioned in transverse direction between the two lateral guides 130.

The terminating element 112 is not designed as a rigid component, but is designed elastically. It is thus intrinsically freely deformable both in the plane of the curtain and transversely thereto and can accordingly adapt itself to obstacles and/or deform elastically around them without damage to or permanent changes of shape of the terminating element 112 occurring. In the illustrated example the terminating element 112 is formed by a bag of flexible material, such as the curtain material, which is formed at the forward edge and into which a slight, flexible and dampening body such as, for instance, foam material or the like, is inserted. Without the transverse force components applied on both sides thereof by the traction element 144 the terminating element 112 would be flexible and/or deformable with low lateral forces already and would not be able to produce a reliable closure in the bottom-side area.

For the transferring of the driving force the traction element 144 comprises a toothed belt 145 which cooperates in a positive locking manner with the drive pinion 143. Moreover, the traction element 144 comprises a traction rope 146 absorbing the driving force of the toothed belt 145 and transferring it further. A weight 147 is provided which has the toothed belt 145 fastened on one side thereof and the traction rope 146 fastened on the other side thereof. The drive 140 further comprises a tension spring 148 which is fixed on the bottom side and cooperates with the traction rope 146.

Furthermore, the drive 140 comprises a buffer container 149 for the toothed belt 145. The toothed belt 145 is fastened in this buffer container 149 with a spring arrangement (not shown) connected therebetween. The buffer container 149 is moreover suited to receive a backlash of the toothed belt 145 during the closing of the door leaf 110 in a certain scope. In the case of a greater length of the tension-free end of the toothed belt 145 the excess length will simply hang over laterally.

If, however, the door leaf 110 is opened, the toothed belt 145 runs over the drive pinion 143 until the door leaf 110 has reached its opened position. In order to mitigate the stopping of the door leaf 110 at the top end of the door opening, the mentioned, non-illustrated spring in the buffer container 149 dampens the last section of the movement path of the toothed belt 145.

The end of the traction rope 146 which is not connected with the weight 147 engages on a lateral edge element 113 of the terminating element 112 and is fastened there, as may in particular be seen in FIG. 4.

The drive 140 further comprises a pulley arrangement 150 over which the traction rope 146 runs. For this purpose, the traction rope 146 is first of all guided over a deflection roll 151 at the free end of the tension spring 148, as may in particular be seen in FIG. 1. Then the traction rope 146 is guided over a further deflection roll 152 at the weight 147. Finally, the traction rope 146 runs over a deflection roll 153 fixed on the bottom side to the associated lateral edge element 113 of the terminating element 112.

In the following, the operating mode of the rolling gate 100 will be explained in more detail.

For the closing of the rolling gate the motor 141 is actuated such that it drives the winding shaft 120 for winding off the door leaf 110. Thus, the door leaf 110 is released from the winding shaft 120.

By the toothed belt 145 the weight 147 is pulled upward in the direction of the winding shaft 120. At the other side of the drive pinion 143 the backlash at the toothed belt 145 is then moved into the buffer container 149 or hangs over laterally, respectively.

By the movement of the weight 147 the traction rope 146 is tensioned. It then runs off over the deflection rolls 151, 152 and 153 such that it tensions the tension spring 148, on the one hand, and applies, with the door leaf-side end, a tension force component on the terminating element 112 for the closing of the door leaf 110, on the other hand. In this manner the closing movement of the door leaf 110 is promoted, i.e. the door leaf 110 is pulled off the winding shaft 120.

As the closing movement of the door leaf 110 continues the door leaf-side end of the traction rope 146 engages on the terminating element 112 at an ever diminishing angle relative to the contact area of the rolling gate 100, as may in particular be seen from FIG. 4. Accordingly, an ever increasing transverse force component engages on the lateral edge elements 113 of the terminating element 112. When the rolling gate 100 is closed, the traction rope 146 is positioned approximately at an angle of 40° to 50° to the associated lateral edge element 113 at the terminating element 112. The transverse force component existing thereby is sufficient to tension the terminating element 112 expediently in transverse direction between the lateral guides 130.

If the door leaf 110 is completely closed, the weight 147 reaches its highest position above the contact area of the rolling gate 100. Furthermore, the tension spring 148 is also tensioned maximally in this state. It is thus achieved that the door leaf 110 opens automatically in an emergency case, for instance, in the case of a power failure. The weight 147 and the tension spring 148 thus constitute a weight balancing means which actively supports an opening movement of the door leaf 110.

For the opening of the door leaf 110 the motor 141 is driven in the opposite direction, so that the curtain section 111 is wound on the winding shaft 112. Simultaneously, the forward edge of the door leaf 110 is released gradually by the toothed belt 145 and the traction rope 146, so that a controlled opening movement of the door leaf 110 and a crease-free winding of the same on the winding shaft 120 is enabled. As was already explained above, the backlash in the toothed belt 145 is pulled out of the buffer container 149 until its elastic fastening in the buffer container 149. This spring force prohibits hard stopping of the door leaf 110 in the course of the winding process. It is thus possible to reliably prevent damages to the door leaf 110. The weight 147 is then positioned in its lowermost position closest to the contact area and the tension spring 148 is also largely relieved.

The door leaf 110 of the rolling gate 100 is thus pulled actively to its closed position by the traction effect on the traction rope 146 of the traction element 144, wherein the traction rope 146 provides a tension force component which is substantially directed in the direction of movement of the door leaf. Simultaneously, however, the traction rope 146 also provides a transverse force component to the terminating element 112 by means of which it is tensioned in transverse direction between the lateral guides 130.

In cases of collision the elastically designed terminating element 112 is, despite the tensioning by the transverse force components, however capable of deforming and of thus avoiding damages to the terminating element 112 or the object hitting. In this case the tension spring 148 releases a certain length of traction rope 146 in a predetermined manner in correspondence with the force acting, so that the terminating element 112 may perform an appropriate deformation. The force acting on the terminating element 112 in the case of such a collision is thus assumed elastically by the tension spring 148 through the pulley arrangement.

Moreover, in the course of the opening or closing movement the tension spring 148 also has a balancing effect with respect to the forces applied on the door leaf 110 by the winding shaft 120, on the one hand, and by the traction element 144, on the other hand. Excessive wear of the components of the drive 140 and of the door leaf 110 is thus prevented.

For the sake of completeness it has to be noted that the foregoing explanation has merely considered one side of the rolling gate 100. The opposite lateral edge region is substantially designed in mirror image, except for the motor 141 and the transmission gearing 142 which are provided on one side of the rolling gate 100 only.

FIGS. 5 to 11 illustrate a second embodiment of the invention by means of a rolling gate 200.

In FIGS. 5*a* and 5*b* the rolling gate 200 is illustrated in an open state while it is illustrated in a closed state in FIGS. 6*a* and 6*b*.

As may be gathered from these Figures, the rolling gate 200 also comprises a door leaf 210 which is formed substantially of a flexible curtain with a curtain section 211 and an elastically designed terminating element 212. Furthermore, the rolling gate 200 comprises a winding shaft 220 and lateral guides 230, only one of which is illustrated in the Figures for illustration purposes. Finally, the rolling gate 200 also comprises a drive 240 for providing the driving force for the operation of the door leaf 210.

As may in particular be seen from FIG. 7, each of the lateral guides 230 comprises a frame box 231. This frame box 231 contains a feed hopper 232 opening into a guide slit 233 in which the door leaf 210 is received with clearance.

The drive 240 comprises a motor 241 and a transmission gearing 242, as may in particular be seen in FIGS. 5*b* and 6*b*. They drive the winding shaft 220. A drive pinion 243 cooperating with a traction element 244 is moreover arranged on the winding shaft 220. The traction element 244 is designed to have several parts in this embodiment and comprises a driving part and a tension force transferring part. The driving part comprises a toothed belt 245 and a drive traction rope 246*a*. They are designed as endless elements in this embodiment, i.e. are arranged relative to each other such that they are capable of circulatingly transferring a tension force. The tension force transferring part comprises a traction rope 246 which finally transfers the tension force to lateral edge elements 213 of the terminating element 212.

Similar to the first embodiment, a weight 247 and a tension force 248 are also arranged at the rolling gate 200. The weight 247 is received between one end of the toothed belt 245 and of the drive traction rope 246*a*. The drive traction rope 246*a* is finally deflected over a deflection roll 254 fastened on the bottom side and is guided to a stop 255. The other end of the toothed belt 245 is fastened to this stop 255.

During operation of the drive pinion 243 the toothed belt 245 is thus moved circulatingly along a predetermined movement path together with the weight 247, the drive traction rope 246*a* and the stop 255.

The traction rope 246 is also fastened to the weight 247. It is further guided over a pulley arrangement 250 to the lateral edge element 213 at the terminating element 212. For this purpose, the pulley arrangement 250 comprises a deflection roll 251 at the tension spring 248 and a further deflection roll 252 at the weight 247, similar to the configuration of the first embodiment. The traction rope 246 is then deflected over a deflection roll 253 fastened on the bottom side such that it can finally act on the lateral edge elements 213 of the terminating element 212.

Other than in the first embodiment, however, the traction rope 246 here runs on both sides over a carriage 260 which is guided in the area of the associated lateral guide 230. For this purpose the carriage 260 comprises rolls 261 by means of which it props adjacently to the guide slit 233 within the frame box 231 and is moved to roll. The carriage 260 further comprises a deflection section 262, here in the form of a roll, by means of which the traction rope 246 is deflected such that it engages on the lateral edge element 213 of the terminating element 212 at a particular angle which is the same in all closing positions of the door leaf 210. For this purpose the carriage 260 is moved together with the terminating element 212 when the door leaf 210 is moved.

The carriage 260 is connected with the terminating element 212. In accordance with the illustration in FIG. 8 each lateral edge element 213 of the terminating element 212 comprises an engagement hook 214 engaging in a form-locking manner into a snap-in nose 263 on the sledge 260. This connection is releasable in the case of collision.

In order that an unlocking of the terminating element 212 from a carriage 260 can be detected, a sensor element 265 is further arranged on the carriage 260. It cooperates with a sensor part 215 on a lateral edge element 213. If the relative position of the sensor part 215 with respect to the sensor element 265 changes, a swiveling out of the terminating element 212 from the plane of the door leaf and/or a deformation of the terminating element 212 in the plane of the door leaf can be detected and a failure routine or the like can be initiated. The sensor consisting of the sensor element 265 and the sensor part 215 is here designed as a magnetic switch.

The functioning of the rolling gate 200 is in principle similar to that of the rolling gate 100 according to the first embodiment. For the closing of the door leaf 210 here, too, a driving force is exerted by the motor 241 via the transmission gearing 242 on the drive pinion 243 such that the toothed belt 245 pulls the weight 247 in the direction of the winding shaft 220. Thus, the drive traction rope 246*a* is also pulled and in turn pulls the stop 255 downward and thus, due to the circulating configuration with the toothed belt 245, keeps the same under tension. At the same time the door leaf 210 is released from the winding shaft 220.

With the shifting of the weight 247 the traction rope 246 is also pulled. The tension spring 248 is tensioned via the pulley arrangement 250 and the tension force of the traction rope 246 is further transferred via the carriage 260 to the terminating element 212. Thus, a tension force component is applied thereon for the closing of the door leaf 210.

For the opening of the door leaf 210 the motor 241 is driven in the opposite direction, so that the door leaf 210 is wound on the winding shaft 220. At the same time the toothed belt 245 is driven in a direction in which the weight 247 can be lowered in the direction of the contact area of the rolling gate 200. Accordingly the tension spring 248 releases and, via the pulley arrangement 250, the traction rope 246 is given a backlash such that it enables the lifting of the forward edge of the door leaf 210. Once the door leaf 210 has reached its upper position, i.e. the completely opened position, the stop 255 hits a corresponding counterpart on the frame side and thus prevents the winding of the door leaf 210 beyond a predetermined point. The stop 255 is elastically pretensioned, so that abrupt stopping of the door leaf does not occur.

As was already explained above, the deflection section 262 at the respective carriage 260 has the effect that the traction rope 246 engages always at the same angle on the lateral edge element 213 of the terminating element 212. The relation of the magnitude of the transverse force component to the tension force component therefore remains the same in all closing positions of the door leaf 210. The magnitudes of the transverse force component and of the tension force component increase with the continuing approach to the closed position of the door leaf 210 due to the increasing pretension of the tension spring 248. The forward edge of the door leaf 210 with the terminating element 212 arranged thereon is, however, tensioned in any position of the door leaf 210.

Like in the first embodiment, the configuration of the rolling gate 200 also allows an emergency opening if for instance, the power supply fails. Then, the door leaf 210 opens automatically due to the mass of the weight 247 and the pretension of the tension spring 248.

While it was possible for the door leaf in the first embodiment to exit from the lateral guides in the case of collision, the rolling gate 200 enables a swiveling out of a middle section of the terminating element 212 from the plane of the door leaf in the case of collision. Then, the snapping connection between the lateral edge elements 213 and the respectively associated carriage 260 illustrated in FIG. 8 is released. In this process, the engagement hook 214 is disengaged from the snap-in nose 263. This state is illustrated in FIG. 9. At the same time, however, the connection of the traction rope 246 with the terminating element 212 is maintained. This facilitates the reestablishment of the snapping connection between the terminating element 212 and the carriage 260. In the case of the rolling gate 200 this is performed in the course of the closing of the door leaf 210.

If the snapping connection between the carriage 260 and the terminating element 212 is released, the carriage 260 does no longer move together with the door leaf 210. It thus rests substantially at the lower end of the associated lateral guide 230. If the somewhat opened door leaf 210 is closed and thus lowered to the carriages 260, the engagement hooks 214 on both sides of the terminating element 212 get into contact with a respective guiding chamfer 264 on the carriage 260 and slide down thereon until they snap again into the snap-in noses 263. These processes are illustrated in FIGS. 10 and 11. Thus, the snapping connection between the carriage 260 and the terminating element 212 has been reestablished.

It has to be added that the angle of attack of the traction rope 246 at the lateral edge element 213 is different in the released snapping connection than in the normal operating condition. Then, the traction rope 246 engages on the lateral edge element 213 at a larger angle to the contact area of the rolling gate 200, so that increased tension force in the door closing direction is provided. This facilitates the process of reestablishment of the snapping connection between the lateral edge element 213 and the respective carriage 260.

In cases of collision it is, due to the elastic properties of the terminating element 212 and of the tension spring 248, also possible here to produce a backlash at the traction rope 246, so that, on the one hand, the terminating element 212 can swivel out of the plane of the door leaf and, on the other hand, an elastic deformation of the terminating element 212 in the plane of the door leaf and also transversely thereto is also enabled. Thus, damage to the terminating element 212 can be avoided in a particularly reliable manner. Moreover, the danger of damage to hitting objects and the danger of injury for persons participating in such a collision are also reduced.

As may in particular be seen from FIG. 7, the snap-in nose 263 on the carriage 260 has a shape which is complementary to the feed hopper 232 of the lateral guides 230. Thus, the carriage 260 can be guided particularly well on the associated frame box 231. The engagement hook 214 at the lateral edge element 213 also comprises a corresponding configuration matching with the feed hopper 232 at the side facing thereto, so that the engaging of the terminating element 212 in the case of collision is facilitated. In other words, the feed hopper 232 guides the engagement hook 214 laterally during reengaging in the snap-in nose 263 such that the reestablishment of this snapping connection is possible in a particularly reliable manner. A quick resetting of the rolling gate 200 in its normal operating condition is thus possible after a case of collision.

Like in the first embodiment the rolling gate 200 is explained in detail in the Figures only by means of one lateral edge region. It is to be understood that the configuration in the region of the other lateral guide is of substantially mirror image design.

In addition to the embodiments explained the invention allows for further design approaches.

Thus, it is possible to do without the weight 147 and/or 247 in some applications. This is in particular the case if the tension spring 148 and/or 248 provides sufficient reset force for an emergency opening of the rolling gate 100 and/or 200, or if such an emergency opening function is not necessary.

On the other hand it is, however, also possible to do without the tension spring 148 and/or 248 in particular applications. Then, a corresponding pretensioning effect can be achieved due to the influence of gravity on the weight 147 and/or 247, or such a function is renounced.

Furthermore, it is not stringently necessary to provide a pulley arrangement 150 and/or 250. Basically it would also be possible to establish a direct operative connection between the drive pinion via the toothed belt and the traction rope to the terminating element 112 and/or 212. Expediently, an elastic length compensation for the traction element could be provided for this purpose at a suitable place in this traction connection.

The traction element 144 and/or 244 may, instead of a toothed belt or a chain, also comprise a traction band which is wound, for instance, in the region of the winding shaft 120 and/or 220.

As may be gathered from the embodiments explained, the terminating element of the door leaf may on both sides also be detachably coupled with the respective carriage such that it exits from this connection in the case of collision without leaving the plane of the door leaf. This is, for instance, the case if the door leaf is lowered to an obstacle during closing. Due to the deformation of the terminating element in the plane of the door leaf which is produced in this process the connection to the respective carriage will then be released.

The connection between the carriage 260 and the terminating element 212 may also be performed in a manner different from a snapping connection. Thus, coherence by magnetic forces may, for instance, be established. Alternatively it is also possible to establish a connection by means of shearing pins or the like, wherein the releasability of this connection has been predetermined appropriately.

The reestablishment of the connection between the terminating element 212 and the associated carriage in the case of a swiveled terminating element 212 may also be performed in another manner and in another position in the movement path of the door leaf 210. For instance, this is also possible at the upper end of the lateral guides 230 which is adjacent to the winding shaft.

Furthermore, the sensor device with the sensor element 265 and the sensor part 215 may be renounced if such automatic detection of a case of collision is deemed not to be required.

Instead of the magnetic switch described, any other kind of sensor for detecting a case of collision may also be used.

The deflection section 262 may also be designed in the form of a sliding guide or the like instead of the roll explained.

The two embodiments explained each show rolling gates in the form of lifting gates. Other orientations of the door leaf such as inclined or horizontally oriented door leaves are, however, also possible.

The invention claimed is:

1. A high-speed rolling gate, comprising:

a door leaf in the form of a flexible curtain, lateral guides in which lateral edges of the door leaf are received, and a drive which generates a driving force for driving the door leaf, the drive comprising a plurality of traction elements, each traction element being located adjacent a respective lateral guide, wherein the door leaf comprises an elastically deformable terminating element on a forward edge of the door leaf, each traction element transferring the driving force to the terminating element of the door leaf such that the terminating element of the door leaf is tensioned between the lateral guides by a laterally applied transverse force component of the driving force, wherein the traction elements of the drive engage the terminating element of the door leaf and thus provide the laterally applied transverse force component of the driving force for tensioning the terminating element of the door leaf and provide a tension force component of the drive force applied to the terminating element of the door leaf substantially directed in a closing direction of the door leaf for closing the door leaf;

wherein each traction element is configured in two-part form with a driving part and a tension force transferring part, wherein the driving part is configured as an endless element for transferring the driving force, and wherein the tension force transferring part transfers the drive force transferred with the driving part to the terminating element of the door leaf; and wherein the transferring part comprises a weight balancing device comprising a tension spring.

2. The rolling gate according to claim 1, wherein the driving part of the traction element is formed as a toothed belt or a chain at least in a partial section.

3. The rolling gate according to claim 1, wherein the tension force transferring part of the traction element is formed as a traction rope.

4. The rolling gate according to claim 1, wherein the drive comprises a pulley arrangement over which the traction element is guided.

5. The rolling gate according to claim 1, wherein the terminating element of the door leaf has a plurality of terminal ends, each terminal end being coupled with a respective carriage, each carriage being movable in a guided manner along with the terminating element in a respective lateral guide and carrying a deflecting member by which the traction element is deflectable from the region of the lateral guide to the terminating element.

6. The rolling gate according to claim 5, wherein the carriages are guided in the lateral guides by rolls.

7. The rolling gate according to claim 5, wherein each terminal end of the terminating element of the door leaf is detachably coupled with its associated carriage such that the terminating element of the door leaf is deflectable from the plane of the door leaf in cases of collision.

8. The rolling gate according to claim 5, wherein the carriages are each connected to lateral edge elements of the terminating element by a snapping connection.

9. The rolling gate according to claim 8, wherein the snapping connection is formed such that the lateral edge elements of the terminating element, if the terminating element is deflected, automatically snap into the carriages in the course of movement of the door leaf in a closing direction.

10. The rolling gate according to claim 5, wherein a sensor device is arranged on at least one carriage, said sensor device detecting the coupling state between the at least one carriage and the terminating element.

* * * * *